US007232364B2

(12) United States Patent
Hibbard

(10) Patent No.: US 7,232,364 B2
(45) Date of Patent: Jun. 19, 2007

(54) ABRASIVE CLEANING ARTICLE AND METHOD OF MAKING

(75) Inventor: Lou D. Hibbard, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/051,838

(22) Filed: Feb. 4, 2005

(65) Prior Publication Data

US 2006/0178090 A1 Aug. 10, 2006

(51) Int. Cl.
*B08B 9/00* (2006.01)

(52) U.S. Cl. ..... 451/526; 15/104.93; 15/229.12; 401/196

(58) Field of Classification Search ..... 451/54, 451/56, 59, 526, 534, 540; 252/174.23; 401/196, 401/200, 201; 15/104.93, 229.12; 51/295
See application file for complete search history.

(56) References Cited

U.S. PATENT DOCUMENTS 2,958,593 A 11/1960 Hoover et al.
2,969,626 A 1/1961 Rudes
4,189,395 A 2/1980 Bland
4,203,857 A 5/1980 Dugan
4,227,350 A 10/1980 Fitzer
4,421,526 A 12/1983 Strickman et al.
4,569,861 A 2/1986 Smith et al.
4,594,362 A * 6/1986 Smith et al. ..... 510/281
4,861,511 A * 8/1989 Kaplan ..... 510/193
4,991,362 A 2/1991 Heyer et al.
5,025,596 A 6/1991 Heyer et al.
5,269,821 A 12/1993 Helmin et al.
5,492,550 A * 2/1996 Krishnan et al. ..... 51/298
5,507,968 A 4/1996 Palaikis
5,586,926 A * 12/1996 Wedell et al. ..... 451/59
5,626,512 A 5/1997 Palaikis et al.
5,685,935 A 11/1997 Heyer et al.
5,712,210 A 1/1998 Windisch et al.
5,749,773 A * 5/1998 Tabata ..... 451/66
6,017,831 A 1/2000 Beardsley et al.
6,139,594 A * 10/2000 Kincaid et al. ..... 51/295
6,491,899 B1 * 12/2002 Leinen et al. ..... 424/49
6,617,295 B2 * 9/2003 Nitzsche ..... 510/188
6,656,018 B1 12/2003 Hsu et al.
2004/0102574 A1 5/2004 Barber, Jr. et al.
2004/0142637 A1 7/2004 Petroski et al.
2004/0142638 A1 7/2004 Petroski et al.
2004/0244132 A1 12/2004 Ouellette et al.
2005/0250667 A1 * 11/2005 Quellet et al. ..... 510/444

OTHER PUBLICATIONS

Des 29/190152; Dotterman, et al.; filed Sep. 16, 2003; and 4 pgs. (includes drawings).
Des 29/190153; Aubourg, et al.; filed Sep. 16, 2003; and 4 pgs. (includes drawings).
U.S. Appl. No. 10/663,535; Kubes, et al.; filed Sep. 16, 2003; and 27 pgs. (includes drawings).

* cited by examiner

*Primary Examiner*—Jacob K. Ackun, Jr.
(74) *Attorney, Agent, or Firm*—Trisha D. Adamson

(57) ABSTRACT

The present invention provides an abrasive cleaning article, a method of making an abrasive cleaning article, and a method of cleaning a surface with an abrasive cleaning article. In one aspect, the abrasive cleaning articles comprises a substrate, a water-soluble binder having a weight average molecular weight less than 200,000, and a plurality of abrasive particles releasably secured to the substrate by the water-soluble binder. The abrasive particles release from the substrate upon contact with a solvent.

11 Claims, 1 Drawing Sheet

ABRASIVE CLEANING ARTICLE AND METHOD OF MAKING

BACKGROUND

The present invention relates to a cleaning article, a method of making a cleaning article, and a method of using a cleaning article. Particularly, the present invention relates to a cleaning article with abrasive particles releasably secured to the cleaning article by a water-soluble binder, a method of making a cleaning article, and a method of cleaning a surface with a cleaning article.

During cleaning, the surface may include built-up dirt, debris, or mineral deposits, which require more than a detergent for removal. Therefore, it may be necessary to use a cleaning article that has scouring capabilities. The scouring capabilities may come from the substrate itself that is being used as the cleaning article, or the souring capabilities may come from abrasive materials added to the substrate. Providing a cleaning article, which itself has scouring capabilities, with an abrasive material enhances the scouring effect of the cleaning article.

A cleaning article may be provided with abrasive particles by pouring an abrasive solution, such as Soft Scrub® available from The Dial Corporation of Scottsdale, Ariz., onto a substrate. However, this requires both a substrate and a separate scouring solution, which can be inconvenient and messy. Further, the scouring solution is often chemically harsh, and therefore may not be as safe for the user to handle and store. Also, this approach typically does not involve disposable substrates, and so the substrate must be handled and cleaned following use. Reuse of the substrate may be undesirable in heavily soiled or contaminated cleaning areas.

Another way of providing abrasive particles to the cleaning article is to mechanically adhere the particles to a substrate through use of a separate adhesive or binder layer. There are disadvantages of both soft and hard binders. If the binder layer is too soft, then it is difficult to get enough fracture to expose the abrasive particles. Then, the scouring ability of the abrasive particle is not fully utilized. If the binder layer is too hard, then the substrate is more rigid and stiff for the user to handle. A hard binder is more brittle and therefore allows for fracture to expose the abrasive particles. However, the particles are so rigidly attached that scratching is more likely to occur.

Binders typically do not allow for the release of the abrasive particles. Mechanically adhered particles are more likely to cause scratching on a surface. The particles are rigidly attached to the substrate and when the substrate is slid across the surface, the particle drags along the surface as well. If the particle is not released and allowed to tumble, scratching is likely to occur and will effect the texture of the surface being cleaned.

The additional binder layer adds additional costs in making the substrate because additional materials and processing steps are necessary. These additional costs results in the cleaning article product costing more, and therefore not intended for single use.

Repeatably using a cleaning product may be undesirable for certain cleaning situations. Some cleaning environments, such as toilets, showers, and sinks may have a high concentration of dirt, debris, stains, or germs. In such cleaning environments it is desirable to use an abrasive cleaning article because of mineral deposits and stains. However, in order to reuse the cleaning article in such environments, the cleaning article itself must be sanitized. The additional step of sanitizing the cleaning article adds additional time and cost to the cleaning process. Therefore, in some situations, it is desirable that the abrasive cleaning article is disposable.

SUMMARY

In one embodiment, the present invention provides an abrasive cleaning article comprising a substrate, a water-soluble binder having a weight average molecular weight less than 200,000, and a plurality of abrasive particles releasably secured to the substrate by the water-soluble binder. The abrasive particles release from the substrate upon contact with a solvent.

In another embodiment, the present invention provides an abrasive cleaning article comprising a substrate and an abrasive coating to releasably secure abrasive particles to the substrate. The abrasive coating consists essentially of a water-soluble binder having a weight average molecular weight less than 200,000. The abrasive particles release from the water-soluble binder and substrate upon contact with water.

In another embodiment, the present invention provides an abrasive cleaning article consisting essentially of a substrate and abrasive particles releasably secured to the substrate by a solidified surfactant. The solidified surfactant is capable of being dissolved in a solvent and the abrasive particles release from the solidified surfactant when the solvent is exposed to the solidified surfactant.

In another embodiment, the present invention provides a method of making an abrasive cleaning article. The method comprises providing a substrate, mixing a slurry of abrasive particles with a water-soluble binder having a weight average molecular weight less than 200,000, coating the substrate with the slurry, and solidifying the water-soluble binder within the slurry. The water-soluble binder releasably secures the abrasive particles to the substrate.

In another embodiment, the present invention provides a method of cleaning a surface with an abrasive cleaning article. The method comprises providing a substrate with abrasive particles releasably secured to the substrate by a water-soluble binder having a weight average molecular weight less than 200,000, exposing the substrate to a solvent to release a portion of the abrasive particles from the water-soluble binder, and applying force to the substrate over the surface to clean the surface.

While the above-identified drawings and figures set forth one embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale. Like reference numbers have been used to denote like parts.

DETAILED DESCRIPTION

Figure 1:
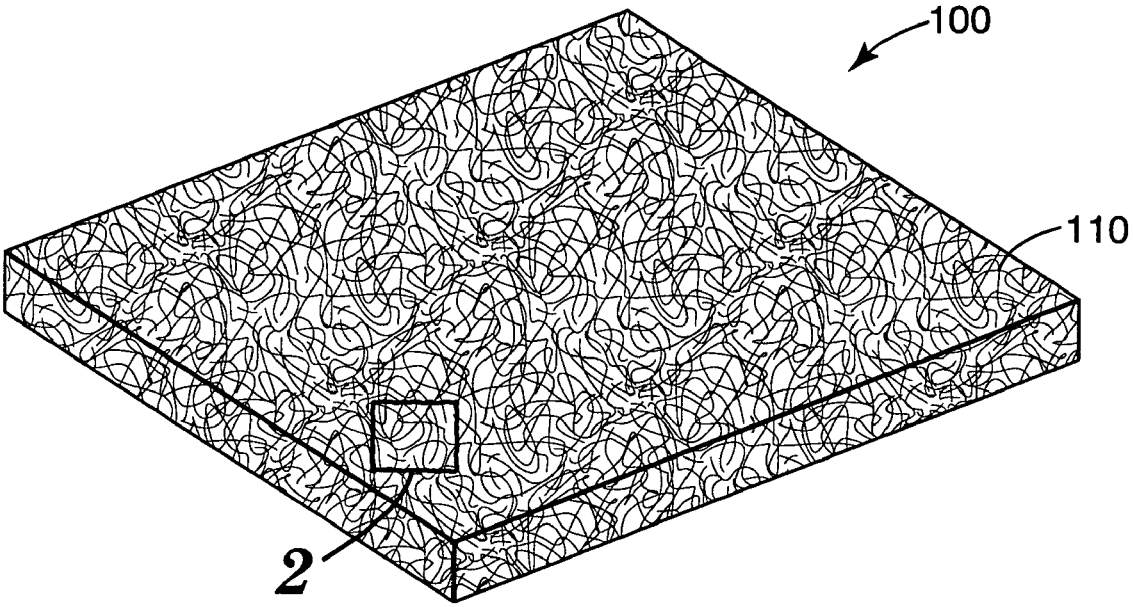
FIG. 1 is a perspective view of an exemplary abrasive cleaning article according to the present invention.
Figure 2:
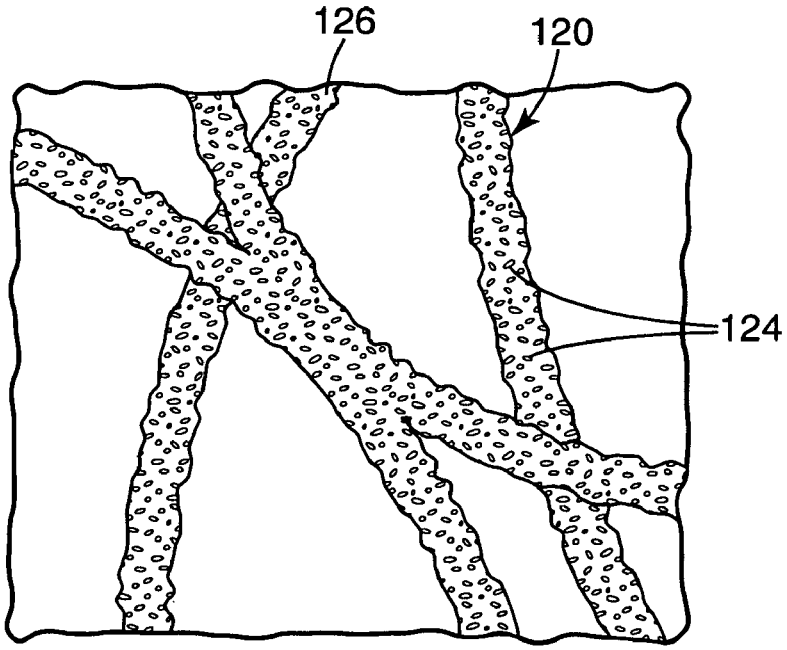
FIG. 2 is an exploded view of a portion of the abrasive cleaning article of FIG. 1.

An exemplary abrasive cleaning article of the present invention is shown in FIG. 1 and an exploded view of a portion of the abrasive cleaning article shown in FIG. 1 is shown in FIG. 2. The abrasive cleaning article 100 comprises a substrate 110 with an abrasive coating 120 of abrasive particles 124. The abrasive coating 120 is in a solid state, which holds the abrasive particles 124 to the substrate 110.

The substrate 110 may be any known material used as cleaning or abrasive cleaning pads. Useful substrates include natural or synthetic sponges, steel wool pads, paper toweling, woven cloth pads, pads formed of narrow aluminum, bronze or plastic fibers or ribbons, nonwoven fabric of varying density, porosity and thickness, nonwoven, lofty, low density abrasive scouring pads, and nonwovens with secured abrasive particles, and composite structures incorporating one or more of the foregoing as elements.

Nonwoven articles are particularly suitable as a substrate for cleaning pads. Nonwoven webs comprising open, lofty, three-dimensional structure of fibers bonded to one another at their mutual contact points are used extensively in the manufacture of abrasive articles for cleaning, abrading, finishing and polishing applications on any of a variety of surfaces.

Nonwoven webs suitable for use in the abrasive cleaning article may be made of, but are not limited to, an air-laid, carded, stitch-bonded, spunbonded, wet laid, or melt blown construction. A preferred nonwoven web is the open, lofty, three-dimensional air-laid nonwoven substrate described in U.S. Pat. No. 2,958,593 to Hoover et al, the disclosure of which is herein incorporated by reference. This nonwoven web is formed by randomly disposed staple fibers. One successful commercial product comprising such a nonwoven web is that sold under the trade designation "Scotch-Brite" available from 3M Company, St. Paul, Minn.

Other approaches to the manufacture of nonwoven articles include use of continuous filaments in the manufacture of a nonwoven web. Exemplary scouring articles made of continuous filaments are those described in U.S. Pat. Nos. 4,991,362 and 5,025,596 to Heyer et al, the disclosures of which are herein incorporated by reference. These patents describe low-density abrasive articles formed with continuous, unidirectional crimped filament tow with the filaments bonded together at opposing ends of the pad.

Fibers suitable for use in abrasive cleaning articles include natural and synthetic fibers, and mixtures thereof. Synthetic fibers are preferred including those made of polyester (e.g., polyethylene terephthalate), nylon (e.g., hexamethylene adipamide, polycaprolactam), polypropylene, acrylic (formed from a polymer of acrylonitrile), rayon, cellulose acetate, polyvinylidene chloride-vinyl chloride copolymers, vinyl chloride-acrylonitrile copolymers, and so forth. Suitable natural fibers include those of cotton, wool, jute, and hemp. The fiber used may be virgin fibers or waste fibers reclaimed from garment cuttings, carpet manufacturing, fiber manufacturing, or textile processing, for example. The fiber material can be a homogenous fiber or a composite fiber, such as bicomponent fiber (e.g., a co-spun sheath-core fiber). It is also within the scope of the invention to provide an article comprising different fibers in different portions of the web (e.g., the first web portion, the second web portion and the middle web portion). The fibers of the web are preferably tensilized and crimped but may also be continuous filaments formed by an extrusion process such as that described in U.S. Pat. No. 4,227,350 to Fitzer, incorporated herein by reference, as well as the continuous fibers described by the aforementioned '362 and '596 patents to Heyer et al.

Where the nonwoven web is of the type described by Hoover et al., identified above, satisfactory fibers for use in the nonwoven web are between about 20 and about 110 millimeters and preferably between about 40 and about 65 millimeters in length and have a fineness or linear density ranging from about 1.5 to about 500 denier and preferably from about 15 to about 110 denier. It is contemplated that fibers of mixed denier can be used in the manufacture of a nonwoven web in order to obtain a desired surface finish. The use of larger fibers is also contemplated, and those skilled in the art will understand that the invention is not limited by the nature of the fibers employed or by their respective lengths, linear densities and the like.

The aforementioned nonwoven web is readily formed on a "Rando Webber" machine (commercially available from Rando Machine Company, New York) or may be formed by other conventional processes. Where a spunbonded-type nonwoven material is employed, the filaments may be of substantially larger diameter, for example, up to 2 millimeters or more in diameter.

Useful nonwoven webs preferably have a weight per unit area at least about 20 $g/m^2$, preferably between 20 and 1000 $g/m^2$, more preferably between 300 and 600 $g/m^2$. The foregoing fiber weights typically will provide a web, before needling or impregnation, having a thickness from about 1 to about 200 millimeters, typically between 6 to 75 millimeters, and preferably between 10 and 50 millimeters.

The web may be reinforced, for example, by the application of a prebond resin to bond the fibers at their mutual contact points to form a three-dimensionally integrated structure as described in Hoover et al. The prebond resin may be made of a thermosetting water-based phenolic resin. Polyurethane resins may also be employed. Other useful prebond resins may include those comprising polyureas, styrene-butadiene rubbers, nitrile rubbers, and polyisoprene. Additional crosslinker, fillers, and catalysts may also be added to the prebond resin. Those skilled in the art will appreciate that the selection and amount of resin actually applied can depend on any of a variety of factors including, for example, the fiber weight in the nonwoven web, the fiber density, the fiber type, as well as the contemplated end use for the finished article. Of course, the present invention does not require the use of a prebond resin and the invention is not to be constructed as being limited to nonwoven webs comprising any particular prebond resin.

Application of the prebond resin, when used, can be accomplished by any suitable means including roll coating, spray coating, dry powder coating, suspended powder coating, powder dropping, liquid dip coating, fluidized bed powder coating, electrostatic powder coating, critical gas dilution liquid resin coating, or other commonly used coating processes available to those skilled in the art.

Other known means of forming a three-dimensionally integrated structure from the nonwoven are within the scope of the present invention. As an alternative to a prebond resin applied to the fibers to form the nonwoven, the fibers may be melt-bonded together at a portion of points where they contact one another to form a three-dimensionally integrated structure, as described in U.S. Pat. No. 5,685,935 to Heyer et al.

The abrasive coating 120 carries and secures the abrasive particles 124 to the substrate 110. The abrasive coating 120 comprises a water-soluble binder 126 having a weight average molecular weight less than 200,000. The water-soluble binder 126 is solidified to carry and secure the abrasive particles 124 to the substrate 110 until the abrasive cleaning article 100 is exposed to a solvent. The solvent begins dissolving the water-soluble binder 126 and the abrasive particles 124 release from the abrasive cleaning article 100.

The water-soluble binder 126 having a having a weight average molecular weight less than 200,000 will typically be more readily soluble in water. In other embodiments, the water-soluble binder 126 has a weight average molecular weight less than 100,000, and in further embodiments, the water-soluble binder 126 has a weight average molecular weight less than 10,000. Many water-soluble binders are known. The water-soluble binder 126 may be oligomeric or polymeric, and may include copolymers and blends thereof. Nonlimiting examples of polymers and copolymers suitable for use as water-soluble binders include polyethylene glycol, polyvinylpyrrolidones, polyvinylpyrrolidone/vinyl acetate copolymers, polyvinyl alcohols, carboxymethyl celluloses, hydroxypropyl cellulose starches, polyethylene oxides, polyacrylamides, polyacrylic acids, cellulose ether polymers, polyethyl oxazolines, esters of polyethylene oxide, esters of polyethylene oxide and polypropylene oxide copolymers, urethanes of polyethylene oxide, and urethanes of polyethylene oxide and polypropylene oxide copolymers.

The water-soluble binder 126 may be a surfactant. Additionally, the water-soluble binder 126 may include a combination of various water-soluble binders, one of which may be a surfactant. Also, the water-soluble binder 126 may include a combination of various surfactants. A surfactant is preferable because it provides additional cleaning capabilities to the abrasive article 100.

Surfactants useful in the present invention are those which will readily dissolve in water. Further, the surfactant should provide excellent sudsing, cleaning, and grease cutting properties in normal home cleaning applications to help in removing stains, grease, oil, dirt and debris from the surface to be cleaned.

The surfactant used in abrasive cleaning articles of the invention may include one or more anionic, cationic, nonionic, and amphoteric surfactants as well as combinations of such surfactants. It is desired that the surfactant is mild on the skin of the user and is non-toxic. It is within the scope of the present invention that in blends of one or more anionic, nonionic, cationic, and/or amphoteric surfactants, a higher concentration of anionic surfactants is desired for enhanced foaming and detergency.

Anionic surfactants suitable for use herein include sodium or ammonium salts of sulfonated alkyls, sulfonic acids, sulfated alkyl ethers, sulfated fatty esters and lauryl sulfates. Alkyl sulfates such as sodium lauryl sulfate and ammonium lauryl sulfate can be included as the surfactant. Alkyl ether sulfates such as sodium lauryl ether sulfate are useful in the present invention. Suitable sulfonates include sodium dodecylbenzene sulfonate available commercially under the trade designation "BIO-SOFT D-40" and triethanolamine dodecylbenzenesulfonate available commercially under the trade designation "BIO-SOFT N-300" both available from Stepan Company of Northfield, Ill.

Amphoteric surfactants are mild secondary foaming agents imparting additional detergency as well as enhancing the blend's mildness on the skin. Exemplary of amphoteric surfactants suitable for use in the invention include cocamidopropyl betaines. Another suitable amphoteric surfactant is coco/oleoamidopropyl betaine. Amine oxides are commonly used amphoteric surfactants such as lauramine oxide, lauramidopropylamine oxide, and stearamide oxide.

Nonionic surfactants may be included as low foaming surfactants used for viscosity building or as medium foaming surfactants used for foam boosting. Among nonionic surfactants and foam stabilizers suitable for inclusion herein are monoethanolamides such as cocamide MEA. Diethanolamides such as coconut diethanolamide is suitable for use herein. Various other ethoxylated amines and amides along with fatty alkanolamides can be included as are known to those skilled in the art.

Cationic surfactants can be included to act as an emulsion stabilizer and/or a viscosity builder. Quaternary ammonium chlorides may be used as cationic surfactants.

It is contemplated that other surfactants and blends thereof can be included in the present invention. The invention is not to be limited in any way by the particular water-soluble binder and/or surfactant formulation described herein. The foregoing discussion of specific surfactants should be understood to be exemplary and not limiting in any way.

The water-soluble binder, and when present, the surfactant, acts as a carrier to hold the abrasive particles 124 to the substrate 110. Therefore, it is desirable to utilize a water-soluble binder that upon solidification provides a secure bond of the abrasive particles 124 to the substrate 100. Preferably, flaking, dusting, or shelling of the solidified water-soluble binder will be minimized. Generally, if the water-soluble binder dries solidifies to be more waxy rather than powdery, it will tend to form a better bond with the substrate 110.

Preferably, the water-soluble binder 126 is thermally stable to last through the dry down process or hot melt process coating without excessive decomposition. The water-soluble binder 126 should have no or minimal flow in the package when exposed to high heat and humidity, such as when being shipped through warmer climates. When in the liquid state, the water-soluble binder 126 should have a high enough viscosity after the addition of the abrasive particle 124 so as to avoid the addition of a thickener. Too low of a viscosity may cause settling of the abrasive particle 124 during coating.

The water-soluble binder 126 and surfactant, if present, is soluble in a solvent. The water-soluble binder 126 should be soluble in the solvent that is available for the particular cleaning application. Typically, the abrasive cleaning article 100 is exposed to water during normal household cleaning. Therefore, the water-soluble binder 126 should be soluble in water.

Abrasive particles 124 are releasably secured to the substrate 110 by the water-soluble binder 126. The abrasive particles 124 used in making articles according to the present invention include all known abrasive materials as well as combinations and agglomerates of such materials. In applications where aggressive scouring or other end uses are not contemplated or desired, softer abrasive particles (e.g., those having a Mohs' hardness in the range between 1 and 7) can be used to provide the finished article with a mildly abrasive surface. Suitable soft abrasives include, without limitation, inorganic materials such as flint, silica, pumice, and calcium carbonate as well as organic polymeric materials such as polyester, polyvinylchloride, methacrylate, methylmethacrylate, polycarbonate, and polystyrene as well as combinations of any of the foregoing materials. A preferred soft abrasive is available commercially under the trade designation "Peerless Pumice FFF grade" from Charles B Crystal Co., Inc. of New York.

Harder abrasive materials (e.g., having a Mohs' hardness greater than about 8) can also be included within the abrasive cleaning article of the invention to provide a finished article having a more aggressive abrasive surface. Suitable hard abrasives include, without limitation, aluminum oxide including ceramic aluminum oxide, heat-treated aluminum oxide and white-fused aluminum oxide; as well as silicon carbide, alumina zirconia, diamond, ceria, cubic boron nitride, garnet, and combinations of the foregoing.

The average particle sizes of the foregoing abrasives can range from about 1 to about 2000 microns. When the articles of the invention are to be used manually (e.g., as hand pads), preferred particle sizes for the abrasive particles typically will be less than the average diameter of the filaments when used in the aforementioned nonwoven articles.

In addition to the water-soluble binder 126 and abrasive particles 124, the abrasive coating 120 may also include coloring agents, perfumes, fragrance oils, preservatives, wetting agents, antifoaming agents, coupling agents, suspending agents, pigments, and antibacterial additives. These additional ingredients are well known in the art.

The abrasive cleaning article 100 is a cleaning article, which provides for both scouring and cleaning of a surface. The abrasive cleaning article 100 may be of any convenient size and shape for use in cleaning. Typical sizes will be such that permit holding in the hand of the user. Some applications require larger sizes and irregular shapes, depending on the particular application. One pad shape useful for cleaning toilet bowls is shown and described in U.S. Design Application 29/190,153 filed on Sep. 16, 2003, the disclosure of which is herein incorporated by reference. Also, the abrasive cleaning article 100 may attach to a tool, such as shown and described in U.S. Design Application 29/190,152 and U.S. patent application Ser. No. 10/663,535, both filed on Sep. 16, 2003, the disclosures of which are herein incorporated by reference. If a tool is used, then the abrasive article 100 will be provided with the proper attachment mechanism. A plurality of abrasive cleaning articles 100 may be provided in a perforated roll form as shown and described in U.S. Pat. No. 5,712,210 to Windisch et al., the disclosure of which is herein incorporated by reference. Also, it is within the scope of the present invention that the abrasive cleaning article may be laminated to a film, sponge, or other such article as is known in the art.

To use the abrasive cleaning article 100 to clean a surface, the abrasive cleaning article 100 is exposed to a solvent, typically water, which is capable of dissolving the water-soluble binder 126 and surfactant, if present. Typically the water-soluble binder 126 will include a surfactant to assist with cleaning. The abrasive cleaning article 100 may be submerged in water from a toilet, sink, or bathtub depending on the surface being cleaned. Upon contact with the solvent, the water-soluble binder 126 begins to dissolve. When present, the surfactant provides the detergent for cleaning the surface. When the water-soluble binder 126 begins to dissolve, the abrasive particles 124 are released onto the surface to be cleaned and provide the abrasive material for scouring the surface. If present, surfactant will foam when exposed to the solvent. The foam helps to suspend the released abrasive particle for prolonged use in scouring the surface. Upon continual exposure to the solvent, a majority of the water-soluble binder 126 is dissolved, and therefore a majority of the abrasive particles 124 are exposed to the surface.

The release of the abrasive particles 124 from the substrate 110 assists in scouring the surface. However, because the abrasive particles 124 are not rigidly adhered to the substrate 110 when the abrasive cleaning article 100 is exposed to the solvent, the abrasive particles 124 are allowed to roll during cleaning, which prevents excessive scratching and damage to the surface.

The release of the water-soluble binder 126 and abrasive particles 124 from the substrate 110 reduces the effectiveness of the abrasive cleaning article 100 as a multiple use article for further cleaning and scouring applications. Therefore, upon completion of the cleaning, the user will typically discard the abrasive cleaning article 100. Depending on the size and composition of the abrasive cleaning article 100, the user may throw the abrasive cleaning article 100 in the garbage or flush it down the toilet.

Typically, the abrasive article 100 of the present invention is manufactured by first supplying the substrate 110 and then applying the abrasive coating 120 to the substrate. As discussed above a nonwoven article is preferably used as the substrate 110 and can be manufactured by any know means of manufacturing nonwoven articles, which may include the methods described above.

A slurry is made of the water-soluble binder 126 and abrasive particles 124 to form the abrasive coating 120. In one preferred slurry, the abrasive particles range from 5% wt. to 95% wt. based on the dry weight of the coated mixture, preferably 25% to 75%, and more preferably 30% to 55%. The slurry is thoroughly mixed and coated onto the nonwoven web.

Application of the slurry onto the substrate can be accomplished by any suitable coating means including roll coating, spray coating, dip coating, or other commonly used coating processes available to those skilled in the art. Preferably, the slurry is applied by roll coating using a roll coater.

One, two, or all sides of the abrasive article may be coated with the abrasive coating 120. Also, depending on the substrate, particularly a nonwoven article, some of the slurry may penetrate into the inner portions of the nonwoven article. When coating the abrasive article, each side may be coated independently.

Following coating, the slurry is dried down so that the water-soluble binder solidifies. It is not essential that all of the water is removed from the slurry during drying down, just that the water-soluble binder is capable of securing the abrasive particles to the substrate 110. If the slurry is applied as a hot melt, the slurry is cooled so that the water-soluble binder solidifies.

It is also within the scope of the present invention that the slurry of water-soluble binder and abrasive particles comprises a paste-like consistency, which may be coated onto the substrate. The paste would have a lower water content during coating than a slurry that must be dried down. Therefore, the paste is capable of securing the abrasive particles to the substrate without further drying down. However, it is within the scope of the present invention that the paste may be dried down to further solidify the water-soluble binder and secure the abrasive particles to the substrate.

The solidified water-soluble binder traps the abrasive particles that were in the slurry. Therefore, the abrasive coating 120 is formed on the substrate 10. The solidified water-soluble binder should have sufficient holding capability to secure the abrasive particles to the substrate and not flake or dust.

One preferred abrasive cleaning article 100 of the present invention includes a nonwoven substrate comprised of polyester fiber with a prebond resin and an additional crosslinker. Fillers and a catalyst are also added. A combination of sodium dodecylbenzenesulfonate and triethanolamine dodecylbenzenesulfonate, both surfactants, are used as the water-soluble binder (approximately at 1:1 surfactant ratio based on the dry weight of the coated water-soluble binder mixture). The abrasive particles used are Peerless Pumice FFF grade abrasive particles. The weight percent of the abrasive particles (based on the dry weight of the coated surfactant mixture) may range from 5% to 95%, preferably from 25% to 75%, and more preferably from 30% to 55%. The abrasive cleaning article is then converted into a finished product and packaged for use as a cleaning article.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

Examples

In the Examples that follow, the described test methods were employed.

Test Methods

Wet Schiefer Cut Test

The Wet Schiefer Cut Test was use to evaluate the relative abrasiveness of the articles of the present invention. The articles to be tested were cut into circular samples approximately 4 inches (10.16 cm) in diameter. The articles were secured to the upper turntable of a Schiefer Abrasion Tester (available from Frasier Precision Instrument Company of Hagerstown, Md.) using a mechanical fastener (SCOTCH-MATE DUAL-LOCK SJ3224 Type 170 or equivalent, available from 3M Company, St. Paul, Minn.). Circular acrylic work pieces were employed for each of the articles tested (polymethyl methacrylate available under the trade designation ACRYLITE from Cyro Industries, Rockaway, N.J., having a Rockwell M Ball Hardness of 90–105). The workpieces were approximately 4 inches (10.16 cm) in diameter and ⅛ inch (0.317 cm) thick. The initial dry weight of each workpiece was recorded and the workpiece was centered and secured to the bottom turntable of the abrasion tester, which was fitted with a spring clip retaining plate to secure the workpiece in place. Testing was conducted under a load of 2.26 kg for 1,000 revolutions with water applied to the surface of the acrylic disc during the test at a rate of 40–60 drops/minute. The final weight of the workpiece was then determined. Schiefer cut was then recorded as the difference between the initial eight of the acrylic disc and the final weight of the acrylic disc. Unless otherwise stated, test results reported are for the average of the two major surfaces of each of the pads tested.

Materials

BIO-SOFT D-40 (sodium dodecylbenzenesulfonate, at approximately 40% solids and the remainder water) is available from Stepan Company, Northfield, Ill.

BIO-SOFT N-300 (triethanolamine dodecylbenzenesulfonate, at approximately 60% solids and the remainder water) is available from Stepan Company, Northfield, Ill.

JEMCOLATE ES-3, (sodium lauryl ether sulfate, at approximately 30% solids and the remainder water) is available from JemPak Canada, Inc., Oakville, Ontario, Canada.

CARBOWAX SENTRY PEG 400 NF, FCC Grade, a polyethylene glycol, is available from Dow Chemical Co., Midland, Mich.

Peerless Pumice, grade FFF, is available from Charles B Crystal Co., Inc., New York.

Barton Garnet abrasive, grade W-2, is available from Barton Mines Corporation, North Creek, N.Y.

NYLOSAN GREEN AS-MSF is a liquid dye, available from Clariant Corporation, Coventry, R.I.

NYLOSAN BLUEAS-BAN is a liquid dye, available from Clariant Corporation, Coventry, R.I.

EXAMPLES

Example 1

Slurry Composition

A slurry composition was prepared of the following ingredients:

| | |
|---|---|
| BIO-SOFT D-40 | 8995 grams |
| BIO-SOFT N-300 | 5515 grams |
| Peerless Pumice, grade FFF | 5140 grams |
| NYLOSAN BLUE AS-BAN | 6.3 grams |

Nonwoven Pad

A nonwoven pad was prepared by first forming a web of 2 inch long, 50 denier crimped polyethylene terephthalate staple fibers using a "Rando Webber" web-forming machine (available from Rando Machine Corporation, Macedon, N.Y.) to produce a web approximately 1.3 inches (33 mm) thick. A resinous material was applied to the fibers of the nonwoven web to facilitate bonding of the fibers at their mutual contact points. The resultant coated web was then oven-dried.

The pre-bonded web was then roll coated with the slurry described above to provide a wet coating weight of 1150 grams/meter$^2$ (dry add on weight of 700 grams/meter2). The resultant saturated web was dried in a forced air oven heated to approximately 350° F. (180° C.) having a residence time of approximately 5 minutes. The Schiefer cut value was 0.248 grams for 1000 revolutions.

Example 2

A nonwoven abrasive pad was prepared by as described in Example 1 except that the following slurry composition was used:

| | |
|---|---|
| BIO-SOFT D-40 | 350 grams |
| Barton Garnet abrasive, grade W-2 | 100 grams |
| Water | 27.9 grams |

This slurry was coated onto the nonwoven abrasive pad to provide a wet coating weight of 3395 grams/meter$^2$ (dry add on weight of 1655 grams/meter$^2$). The Schiefer cut value was 0.124 grams for 1000 revolutions.

Example 3

A nonwoven abrasive pad was prepared as described in Example 1 except that the following slurry composition was used:

| | |
|---|---|
| BIO-SOFT D-40 | 350 grams |
| JEMCOLATE ES-3 | 350 grams |
| Peerless Pumice Grade FFF | 200 grams |

This slurry was coated onto the nonwoven abrasive pad to provide a wet coating weight of 2750 grams/meter$^2$ (dry add on weight of 1315 grams/meter$^2$). The Schiefer cut value was 0.188 grams for 1000 revolutions.

Example 4

A nonwoven abrasive pad was prepared as described in Example 1 except that the following slurry composition was used:

| | |
|---|---|
| BIO-SOFT D-40 | 350 grams |
| CARBOWAX | 133 grams |
| Peerless Pumice Grade FFF | 201 grams |
| NYLOSAN GREEN AS-MSF | 3.5 grams |

This slurry was coated onto the nonwoven abrasive pad to provide a wet coating weight of 1110 grams/meter$^2$ (dry add on weight of 755 grams/meter$^2$). The Schiefer cut value was 0.241 grams for 1000 revolutions.

Comparative Testing

For comparison, two commercially available toilet bowl scrubbing pads were tested using the Wet Schiefer Cut Test except that the pad size was limited to the size and shape of the commercial pad, only one side of the pad was tested, and the test was run at a more aggressive setting (5000 revolutions instead of 1000 revolutions). The two product pads tested were the CLOROX TOILET WAND (available from The Clorox Company, Oakland, Calif.) and the SCOTCH-BRITE Disposable Toilet Bowl Scrubbers pad (available from 3M Company, St. Paul, Minn.). The Schiefer cut values for both product pads were essentially zero, indicating that they were less abrasive than the invention product pads.

What is claimed is:

1. An abrasive cleaning article comprising:

a substrate;

a water-soluble surfactant binder having a weight average molecular weight less than 200,000; and a plurality of abrasive particles releasably secured to the substrate by the water-soluble binder;

wherein the abrasive particles release from the substrate upon contact with a solvent.

2. The abrasive cleaning article of claim 1, wherein the substrate is selected from the group consisting of natural sponges, synthetic sponges, steel wool pads, paper toweling, woven cloth pads, and nonwoven pads.

3. The abrasive cleaning article of claim 1, wherein the abrasive particles are pumice.

4. The abrasive cleaning article of claim 1, wherein the abrasive cleaning article further comprises a dye.

5. The abrasive cleaning article of claim 1, wherein the surfactant is an anionic surfactant.

6. The abrasive cleaning article of claim 1, wherein the solvent is water.

7. An abrasive cleaning article comprising:

a substrate; and an abrasive coating to releasably secure abrasive particles to the substrate, the abrasive coating consisting essentially of a water-soluble binder comprising a surfactant having a weight average molecular weight less than 200,000;

wherein the abrasive particles release from the water-soluble binder and substrate upon contact with water; and wherein the abrasive particles have a Moh hardness less than 8 and at least a portion of the abrasive particles have a particle size greater than 25 microns.

8. The abrasive cleaning article of claim 7, wherein the substrate is selected from the group consisting of natural sponges, synthetic sponges, steel wool pads, paper toweling, woven cloth pads, and nonwoven pads.

9. The abrasive cleaning article of claim 7, wherein the abrasive particles are pumice.

10. The abrasive cleaning article of claim 7, wherein the surfactant is an anionic surfactant.

11. An abrasive cleaning article consisting essentially of:

a substrate; and abrasive particles releasably secured to the substrate by a solidified surfactant;

wherein the solidified surfactant is capable of being dissolved in a solvent and wherein article is configured such that the abrasive particles release from the substrate when the solvent is exposed to the solidified surfactant.

* * * * *

UNITED STATES PATENT AND TRADEMARK OFFICE

CERTIFICATE OF CORRECTION

PATENT NO. : 7,232,364 B2
APPLICATION NO. : 11/051838
DATED : June 19, 2007
INVENTOR(S) : Lou D. Hibbard It is certified that error appears in the above-identified patent and that said Letters Patent is hereby corrected as shown below:

Column 8
Line 54, Delete "10" and insert -- 110 --, therefor.

Column 10
Line 45 (Approx.), Delete "meter2)." and insert -- meter$^2$). --, therefor.

Signed and Sealed this

Fourth Day of March, 2008

JON W. DUDAS
*Director of the United States Patent and Trademark Office*